US006668390B1

(12) United States Patent
Gonzalez

(10) Patent No.: US 6,668,390 B1
(45) Date of Patent: Dec. 30, 2003

(54) DEBRIS RECOVERY FOR DRAINAGE SYSTEM

(76) Inventor: Raul Gonzalez, 1955 S. W. 110th Ave., Miami, FL (US) 33172

( * ) Notice: Subject to any disclaimer, the term of this patent is extended or adjusted under 35 U.S.C. 154(b) by 0 days.

(21) Appl. No.: 10/152,366

(22) Filed: May 20, 2002

(51) Int. Cl.[7] ..... E03C 1/26

(52) U.S. Cl. ..... 4/291; 4/286; 210/690; 210/130; 210/162; 210/163

(58) Field of Search ..... 4/286–293, 668, 4/671, 679–682; 210/163, 162, 130–1, 502.1, 690–694

(56) References Cited

U.S. PATENT DOCUMENTS 6,178,565 B1 * 1/2001 Franco ..... 4/291

* cited by examiner

*Primary Examiner*—Gregory Huson
*Assistant Examiner*—Amanda Flynn
(74) *Attorney, Agent, or Firm*—J. Sanchelima; A. Bordas

(57) ABSTRACT

A debris recovery device for drainage systems that includes a shaft with a peripheral wall. A basket made out of a meshed material has a spring loaded hingedly mounted bottom wall that is partially opened when it carries a load of a predetermined weight. A peripheral flange rests on the shoulder of the peripheral wall. An oil trap assembly can be optionally added to catch oil spills before reading the drainage system. The oil trap includes a sheet of a porous oil-absorbing material.

6 Claims, 1 Drawing Sheet

DEBRIS RECOVERY FOR DRAINAGE SYSTEM

BACKGROUND OF THE INVENTION

1. Field of the Invention

The present invention relates to a debris recovery device, and more particularly, to such a device that is used with drainage systems.

2. Description of the Related Art

Many designs for debris recovery in drainage systems have been designed in the past. None of them, however, include a basket or collector including a bottom wall that could be readily open in the event it is clogged and that is activated by the weight of the collected debris.

In a typical drain system, debris accumulates in the shaft causing the system to clog, requiring expensive excavation and maintenance work. The present invention resolves the problem by collecting the debris before it clogs and damages the drain system.

Also, oil spills cause contamination of the soils and drain systems. The basket or collector includes an oil filter to prevent this from happening.

Applicant believes that the closest reference corresponds to U.S. Pat. No. 6,178,565 issued to Jose Franco in January 2001 for a trash collector for exfiltration drain systems. Franco's patented collector is a drain assembly with a shaft and it has an enlarged shoulder at its upper end for supporting the basket assembly by providing a peripheral resting surface. However, it differs from the present invention because it lacks a bottom wall that is opened in the event the basket assembly is clogged. In this manner, the present invention can be unattended for extended periods of time.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a device for collecting debris in drainage systems that automatically releases its clogging load upon reaching a predetermined limit.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
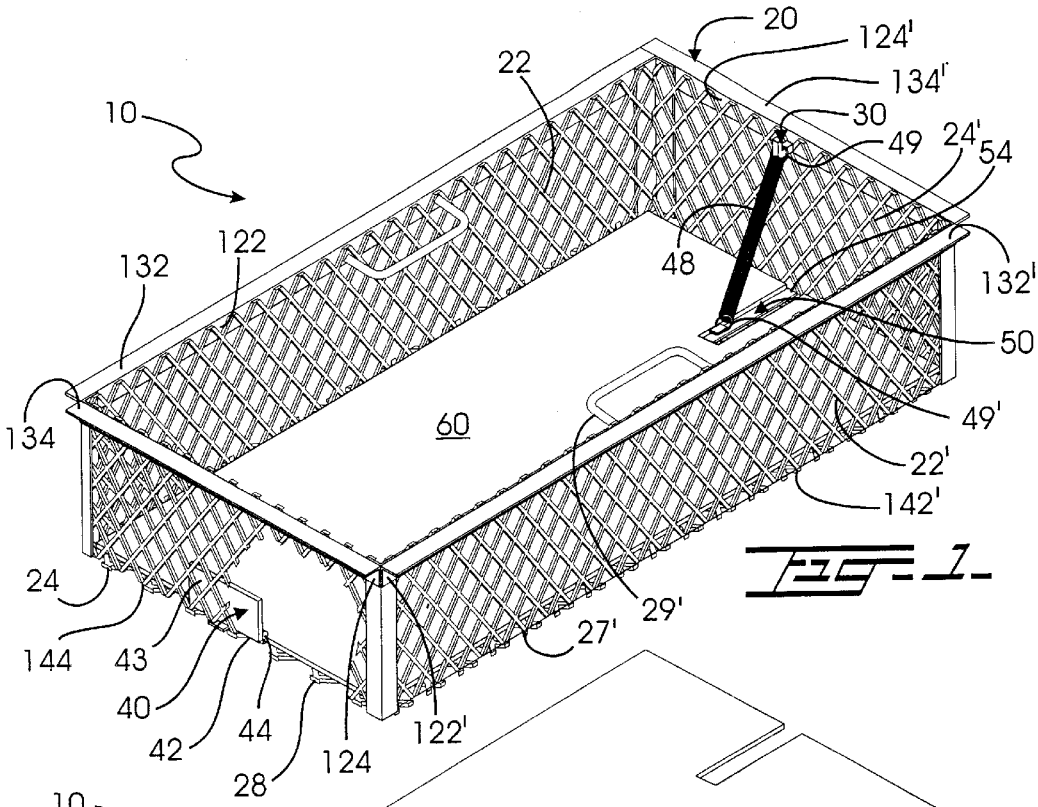
FIG. 1 represents an isometric view of one of the preferred embodiments for the present debris recovery for drainage system with an oil trap sheet. The figure is in partial cross-section to show the hinge assembly.

Referring now to the drawings, where the present invention is generally referred to with numeral 10, it can be observed that it basically includes basket assembly 20, hinge assembly 40 and oil trap 60.

Figure 2:
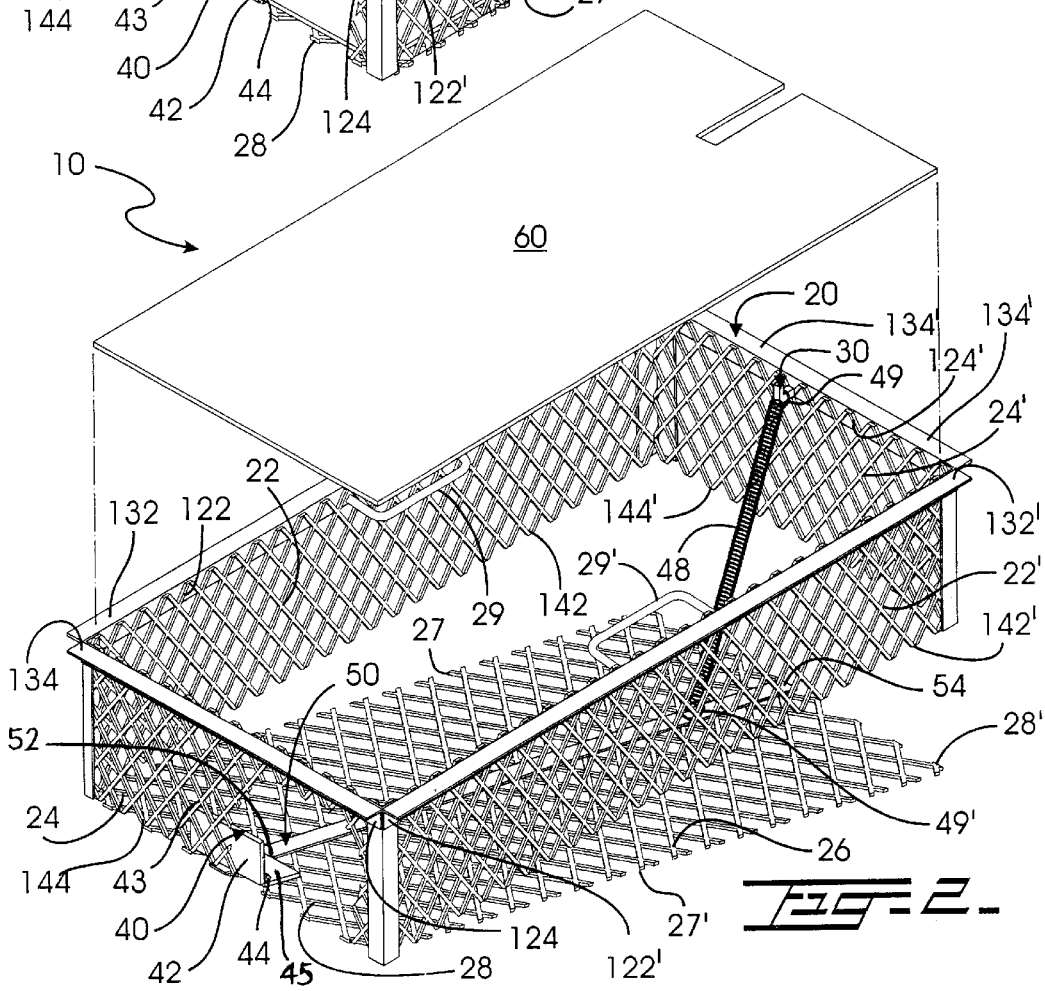
FIG. 2 is an isometric view of the device represented in FIG. 1 showing the bottom wall partially open. The oil trap sheet is shown separated from bottom wall.

As seen in FIG. 1, basket assembly 20 includes longitudinal peripheral walls 22 and 22' parallel to each other, transversal peripheral walls 24 and 24' parallel to each other and bottom wall 26 pivotally mounted to wall 24. Walls 22 and 22' and transversal walls 24 and 24' are perpendicularly disposed. In the preferred embodiment, peripheral walls 22; 22'; 24 and 24' are perpendicularly disposed with respect to bottom wall 26. Walls 22; 22'; 24 and 24' and bottom wall 26 are made out of a meshed material, preferably stainless steel, or any other material that is corrosion resistant, such as aluminum. Bottom wall 26 is hingedly mounted to transversal wall 24. Bottom wall 26 includes longitudinal edges 27 and 27' and transversal edges 28 and 28', as best seen in FIG. 2.

Basket assembly 20 has upper edges 122; 122'; 124 and 124' and lower edges 142; 142'; 144 and 144' for walls 22; 22'; 24 and 24' respectively. Edges 122; 122'; 124 and 124' are reinforced and include perpendicularly and outwardly extending flange members 132; 132'; 134 and 134', respectively. Flange members 132; 132'; 134 and 134' rest on the peripheral shoulder that is parallel to and below the ground where a typical drain system is installed. In the preferred embodiment, handle members 29 and 29' are inwardly and rigidly mounted to edges 122 and 122'. Members 29 and 29' can also be pivotally mounted so they would drop out of the way when not in use.

Hinge assembly 40 includes joint 44 and leaves 43 and 45. Leaf 43 is rigidly mounted to the center of lower edge 144. Leaf 45 is rigidly mounted to the center of transversal edge 28. Spring member 48 has ends 49 and 49'. End 49 is removably mounted to nail 30. Nail 30 is rigidly mounted to edge 124'. End 49' is rigidly mounted to a point next to end 54 of reinforced bar 50.

Reinforced bar 50 includes ends 52 and 54. Bar 50 has substantially the same elongated dimension of bottom wall 26 and extends therealong. Bar 50 is mounted to bottom wall 26. End 52 is rigidly attached to the distal end of leaf 45. End 54 is attached to the center of transversal edge 28'. Bar 50 is intended to provide structural integrity to bottom wall 26, and other equivalent structures can be used.

Oil trap 60 is removably mounted to bottom wall 26. Oil trap 60 has the substantially same dimensions of bottom wall 26. Oil trap 60 is implemented with an oil pad used for this purpose such as the manufactured by 3M, Corp., St. Paul, Minn., under the 3M Brand High Performance Petroleum Sorbent, part numbers 70-0703-1378, 70-0703-1379, 70-0703-1380, and other equivalent materials.

Debris recovery for device 10 collects the debris before it clogs and damages the drain system and/or surrounding area. Debris recovery 10 also avoids the contamination of the soils and drain systems with oils and similar products. In the event an overflow occurs, the force of the water and accumulated debris forces bottom wall to open facilitating the discharge of the device.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A debris recovery device for drainage systems that includes a shaft with a peripheral shoulder, comprising:

A) a basket assembly having peripheral walls defining a common upper edge and a common lower edge, said basket assembly including first and second openings defined by said upper and lower edges, and said peripheral walls made out of a meshed material;

B) a bottom wall having cooperative dimensions to close said second opening, said bottom wall being hingedly mounted to said common lower edge; and C) means for keeping said bottom wall against said common lower edge and releasable upon the application of a predetermined force so that a load supported by said bottom wall is discharged upon reaching a predetermined weight, said means for keeping said bottom wall against said common lower edge includes spring means cooperatively mounted on said basket assembly and connected to said bottom wall for urging the latter against said common lower edge.

2. The device set forth in claim 1 further including:

D) an oil trap assembly mounted over said bottom wall and including an oil-absorbing member.

3. The device set forth in claim 2 wherein, said oil absorbing member is a sheet of a porous material that conforms to the dimensions of said bottom wall.

4. The device set forth in claim 3 wherein said bottom wall is also made out of a meshed material.

5. The device set forth in claim 4 further including:

E) handle mounted to said basket assembly.

6. The device set forth in claim 5 wherein said basket assembly includes a peripheral flange extending outwardly from said common upper edge.

* * * * *